US009170533B2

(12) United States Patent
Saiki

(10) Patent No.: US 9,170,533 B2
(45) Date of Patent: Oct. 27, 2015

(54) BELT DRIVING DEVICE, FIXING DEVICE, AND IMAGE FORMING APPARATUS

(71) Applicant: FUJI XEROX Co., Ltd., Minato-ku, Tokyo (JP)

(72) Inventor: Mikio Saiki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 324 days.

(21) Appl. No.: 13/919,286

(22) Filed: Jun. 17, 2013

(65) Prior Publication Data

US 2014/0105657 A1 Apr. 17, 2014

(30) Foreign Application Priority Data

Oct. 17, 2012 (JP) ..... 2012-229666

(51) Int. Cl.
*G03G 15/20* (2006.01)

(52) U.S. Cl.
CPC ..... *G03G 15/2017* (2013.01); *G03G 15/2053* (2013.01); *G03G 2215/00139* (2013.01); *G03G 2215/00143* (2013.01); *G03G 2215/00156* (2013.01); *G03G 2215/2038* (2013.01)

(58) Field of Classification Search
CPC ..... G03G 2215/00143; G03G 2215/00156; G03G 2215/00139; G03G 2215/2038; G03G 15/2053
See application file for complete search history.

(56) References Cited

U.S. PATENT DOCUMENTS

2008/0310891 A1* 12/2008 Mochizuki ..... 399/302

FOREIGN PATENT DOCUMENTS

| | | |
|---|---|---|
| JP | 2006-225130 A | 8/2006 |
| JP | 2006-267953 A | 10/2006 |
| JP | 2009-025475 A | 2/2009 |

* cited by examiner

*Primary Examiner* — David Gray
*Assistant Examiner* — Andrew V Do
(74) *Attorney, Agent, or Firm* — Sughrue Mion, PLLC

(57) ABSTRACT

A belt driving device includes an endless belt; support members that extend in a width direction of the endless belt and support the endless belt, the support members including a control member that controls the widthwise position of the endless belt; a support body that supports the support members; and a driving mechanism that drives one end of the control member to cause the control member to pivot about a pivot axis in a direction in which stretching of the endless belt is prevented. A portion of the control member shifted from the midpoint toward an edge of the endless belt is pivotably supported by the support member to serve as the pivot axis, so that the moving distances of two points on the control member aligned with the edges of the endless belt when the control member is driven by the driving mechanism are close to each other.

3 Claims, 6 Drawing Sheets

BELT DRIVING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2012-229666 filed Oct. 17, 2012.

BACKGROUND (i) Technical Field

The present invention relates to a belt driving device, a fixing device, and an image forming apparatus.

(ii) Related Art

In a known fixing device, a toner image is fixed onto a medium, such as a sheet, by an endless belt that runs in a loop while being heated and a contact member that comes into contact with the outer surface of the endless belt.

SUMMARY

According to an aspect of the invention, there is provided a belt driving device includes an endless belt that is run in a loop by receiving a supply of driving force; support members that extend in a width direction of the endless belt and support the endless belt, the support members including a control member that controls the widthwise position of the endless belt; a support body that supports the support members; and a driving mechanism that drives one end of the control member to cause the control member to pivot about a pivot axis, which is located at a position overlapping the endless belt, in a direction in which stretching of the endless belt is prevented. A portion of the control member shifted from the midpoint toward an edge of the endless belt in the width direction is supported in a pivotable manner by the support member to serve as the pivot axis, so that the moving distances of two points on the control member that are aligned with the edges of the endless belt in the width direction when the control member is driven by the driving mechanism are closer to each other than those in the case where the pivot axis is located at the midpoint of the endless belt in the width direction.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below.

Figure 1:
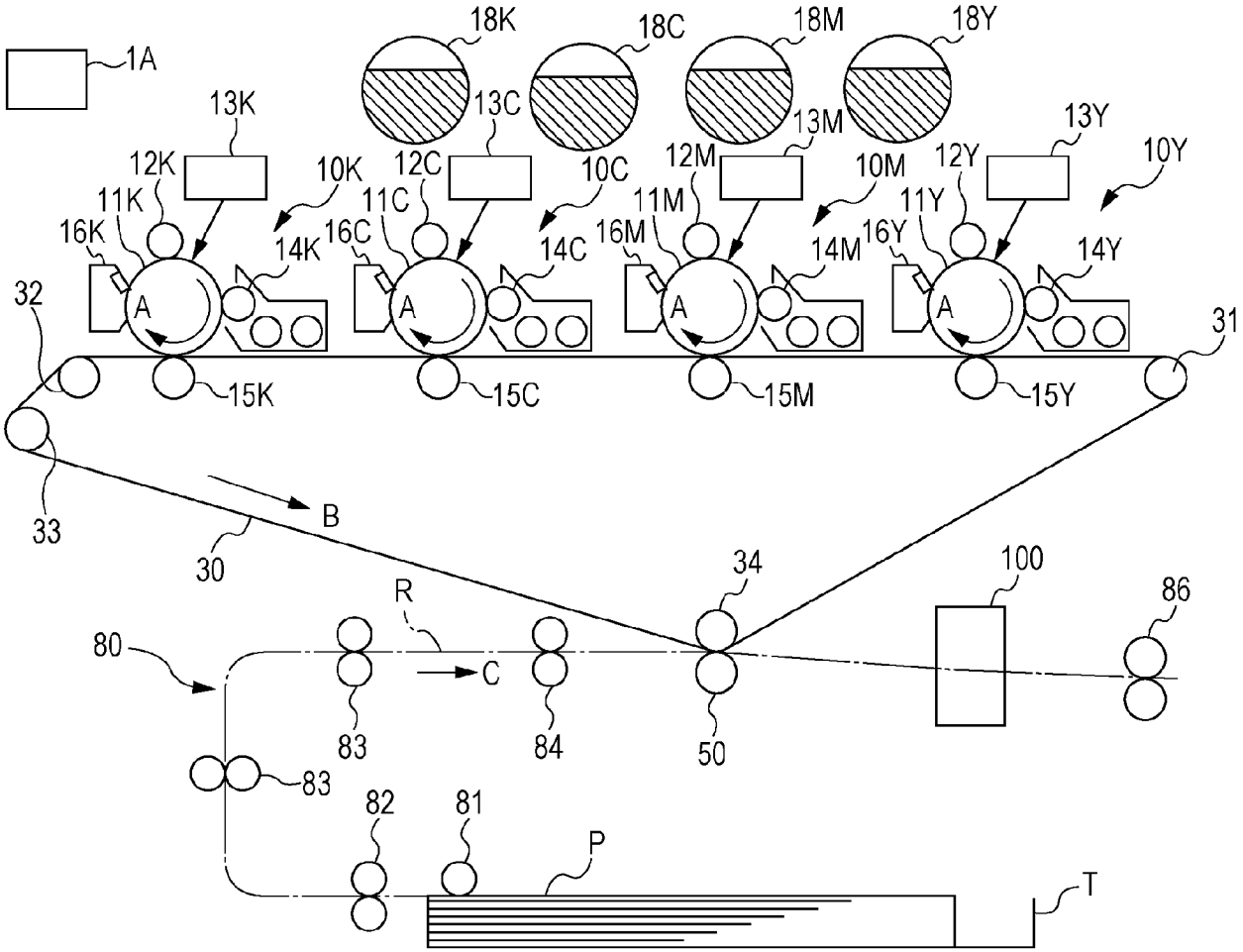
FIG. 1 illustrates an exemplary embodiment of an image forming apparatus of the present invention.

FIG. 1 illustrates the exemplary embodiment of an image forming apparatus of the present invention.

An image forming apparatus 1 illustrated in FIG. 1 is a tandem-type color printer having image forming sections 10Y, 10M, 10C, and 10K corresponding to yellow (Y), magenta (M), cyan (C), and black (K) arranged in parallel. This image forming apparatus 1 prints not only a monochrome image, but also a full-color image formed by overlaying toner images of four colors. Toner cartridges 18Y, 18M, 18C, and 18K contain toners of four colors, Y, M, C, and K, respectively. The toner has an average particle diameter of, for example, 2 μm to 7 μm and has an equivalent circle diameter of 0.95 to 1.0. The toner cartridge 18Y, 18M, 18C, and 18K contain lubricant, which is an external additive to the toner.

Because the four image forming sections 10Y, 10M, 10C, and 10K have substantially the same configuration, the image forming section 10Y corresponding to yellow will be described as a representative example. The image forming section 10Y includes a photoconductor 11Y, a charger 12Y, an exposure unit 13Y, a developing unit 14Y, and a first transfer portion 15Y. The image forming section 10Y also includes a photoconductor cleaner 16Y for cleaning the photoconductor 11Y.

The photoconductor 11Y is a drum formed of a cylindrical base member and a photoconductor layer provided on the surface thereof and is rotated about a shaft in an arrow A direction with an image formed thereon. The charger 12Y, the exposure unit 13Y, the developing unit 14Y, the first transfer portion 15Y, and the photoconductor cleaner 16Y are arranged around the photoconductor 11Y in this sequence in the arrow A direction.

The charger 12Y charges the surface of the photoconductor 11Y. The charger 12Y is a charging roller that comes into contact with the surface of the photoconductor 11Y. The charger 12Y is supplied with a voltage having the same polarity as the toner in the developing unit 14Y to charge the surface of the photoconductor 11Y in contact therewith. The exposure unit 13Y irradiates the photoconductor 11Y with exposure light to expose the surface of the photoconductor 11Y. The exposure unit 13Y emits a laser beam corresponding to an image signal supplied from the outside of the image forming apparatus 1 to scan the surface of the photoconductor 11Y with the laser beam.

The developing unit 14Y develops an image on the surface of the photoconductor 11Y using developer. The toner is supplied from the toner cartridge 18Y to the developing unit 14Y. The developing unit 14Y stirrers the developer, which is the mixture of magnetic carrier and toner, to charge the magnetic carrier and the toner and develops the image on the surface of the photoconductor 11Y using the charged toner. The first transfer portion 15Y is a roller facing the photoconductor 11Y with an intermediate transfer belt 30 therebetween. When a voltage is applied to the photoconductor 11Y, the first transfer portion 15Y transfers a toner image on the photoconductor 11Y to the intermediate transfer belt 30.

The photoconductor cleaner 16Y cleans the surface of the photoconductor 11Y by removing toner (residual toner) left on a part of the surface of the photoconductor 11Y subjected to the transfer by the first transfer portion 15Y.

The image forming apparatus 1 also includes the intermediate transfer belt 30, a fixing device 100, a sheet transport unit 80, and a control unit 1A. The intermediate transfer belt 30 is an endless belt stretched over belt support rollers 31 to 34. The intermediate transfer belt 30 runs in a loop in an arrow B direction, in which the transfer belt 30 pass the image forming sections 10Y, 10M, 10C, 10K, and the second transfer portion 50 in this sequence. Toner images of the respective colors formed in the image forming sections 10Y, 10M, 10C, and 10K are transferred to the intermediate transfer belt 30. The intermediate transfer belt 30 runs with the color toner images formed thereon.

The second transfer portion 50 is a roller facing a back-up roller 34, which is one of the belt support rollers 31 to 34, with the intermediate transfer belt 30 and a sheet P therebetween. When a voltage having an opposite polarity to the charged toner is applied the second transfer portion 50, the toner images on the intermediate transfer belt 30 are transferred to the sheet P.

The image forming sections 10Y, 10M, 10C, and 10K, the intermediate transfer belt 30, and the second transfer portion 50 collectively correspond to an example of the image forming section of the present invention.

The fixing device 100 fixes the toner image on the sheet P. The fixing device 100 corresponds to an exemplary embodiment of the fixing device of the present invention. This fixing device 100 also corresponds to an exemplary embodiment of a fixing section of the image forming apparatus of the present invention. The fixing device 100 will be described in detail below.

The sheet transport unit 80 includes a pick-up roller 81 that picks up a sheet P stored in a sheet container T, separation rollers 82 that separate the picked up sheet P, and transport rollers 83 that transport the sheet P. The sheet transport unit 80 further includes registration rollers 84 that transport the sheet P to the second transfer portion 50, and output rollers 86 that discharge the sheet P to the outside. The sheet transport unit 80 transports the sheet P along a sheet transport path R extending through the second transfer portion 50 and the fixing device 100.

The basic operation of the image forming apparatus 1 illustrated in FIG. 1 will be described. In the image forming section 10Y corresponding to yellow, the photoconductor 11Y is rotated in the arrow A direction, and the surface of the photoconductor 11Y is charged by the charger 12Y. The exposure unit 13Y irradiates the surface of the photoconductor 11Y with exposure light according to an image signal, corresponding to yellow, of image signals supplied from the outside to form an electrostatic latent image on the surface of the photoconductor 11Y. The developing unit 14Y is supplied with yellow toner from the toner cartridge 18Y and develops the electrostatic latent image on the photoconductor 11Y with the toner to form a toner image. The photoconductor 11Y is rotated with the yellow toner image formed on the surface thereof. The toner image formed on the surface of the photoconductor 11Y is transferred to the intermediate transfer belt 30 by the first transfer portion 15Y. After the transfer, the residual toner on the photoconductor 11Y is removed by the photoconductor cleaner 16Y.

The intermediate transfer belt 30 runs in a loop in the arrow B direction. The image forming sections 10M, 10C, and 10K corresponding to the colors other than yellow form toner images of the respective colors, in the same way as the image forming section 10Y. Then, the toner images of the respective colors are transferred to the intermediate transfer belt 30 such that they are superposed on the toner image transferred in the image forming section 10Y.

A sheet P is picked up from the sheet container T by the pick-up roller 81. The sheet P is transported by the transport rollers 83 and the registration rollers 84 in an arrow C direction (toward the second transfer portion 50, along the sheet transport path R). The registration rollers 84 send the sheet P to the second transfer portion 50 based on the timing when toner images are transferred to the intermediate transfer belt 30. The second transfer portion 50 transfers the toner image on the intermediate transfer belt 30 to the sheet P. The sheet P having the toner image transferred thereon is transported to the fixing device 100, where the toner image transferred to the sheet P is fixed. In this manner, an image is formed on the sheet P. The sheet P having an image formed thereon is discharged outside the image forming apparatus 1 by the output rollers 86.

Next, the fixing device 100 will be described.

Figure 2:
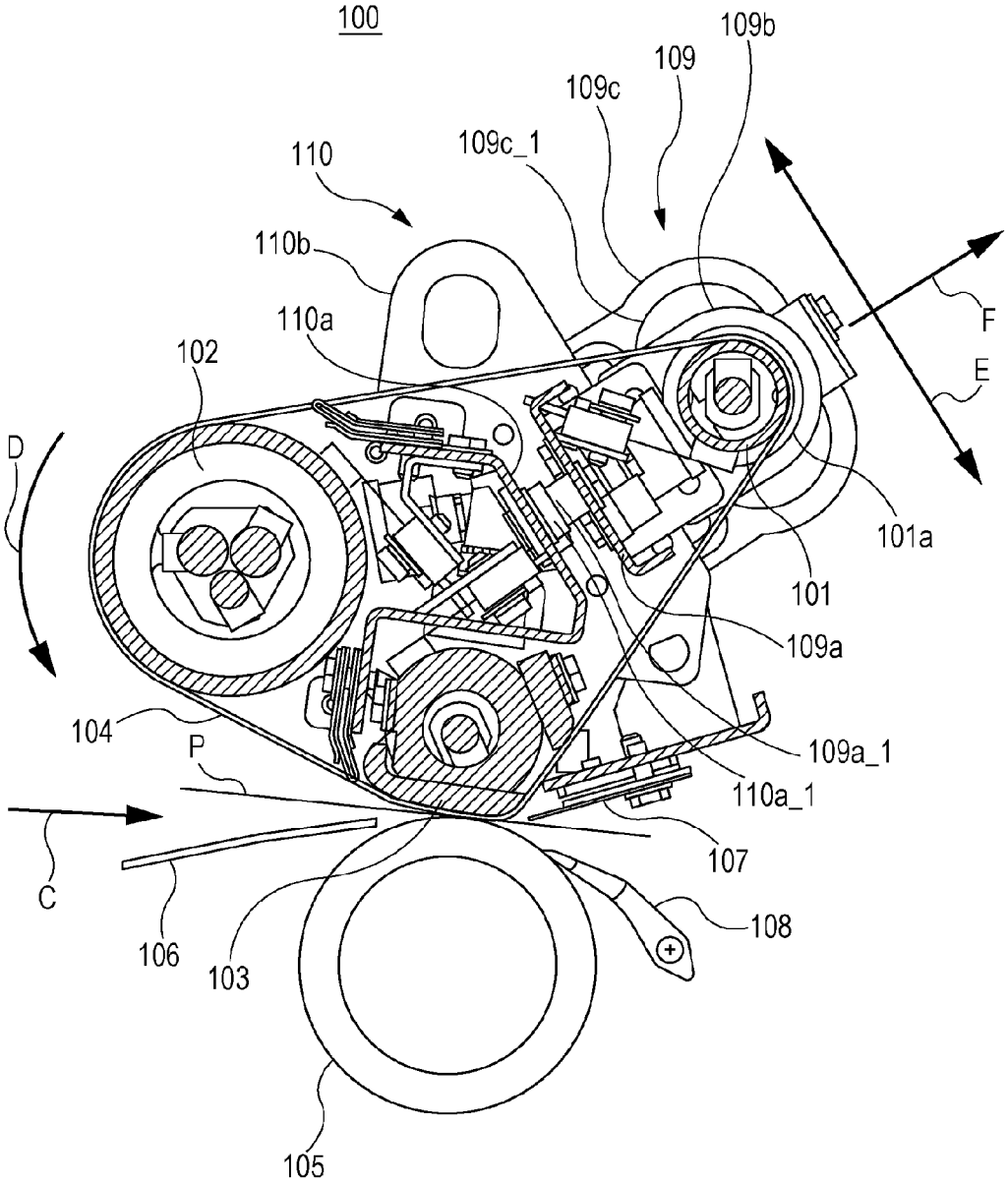
FIG. 2 schematically illustrates the internal structure of a fixing device.
Figure 3:
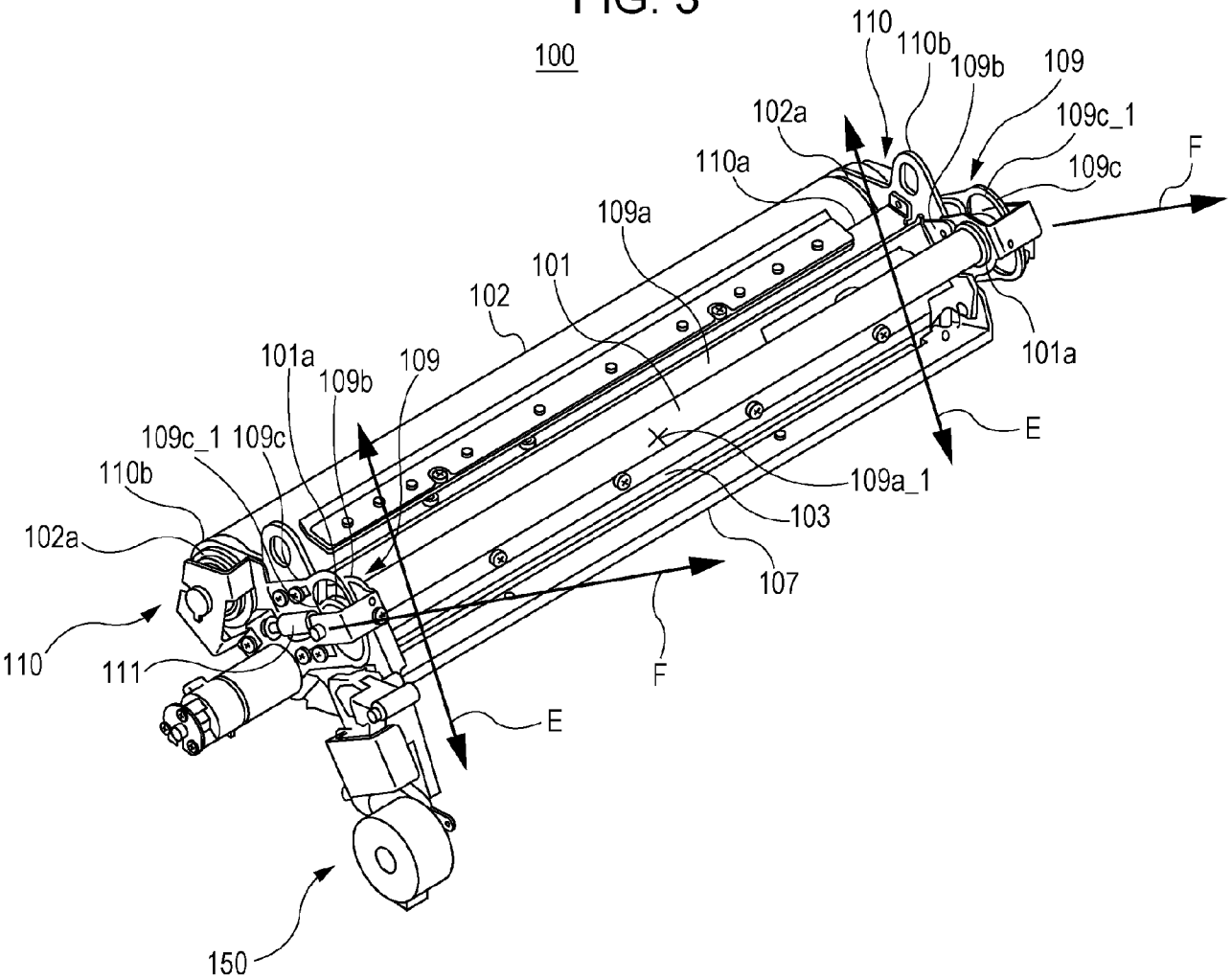
FIG. 3 is a perspective view of the fixing device schematically illustrated in FIG. 2.

FIG. 2 schematically illustrates the internal structure of the fixing device, and FIG. 3 is a perspective view of the fixing device schematically illustrated in FIG. 2. FIG. 3 illustrates the fixing device without the endless belt 104 so that the internal structure of the fixing device may be viewed. Furthermore, in FIG. 3, pressure rollers (described below) that are behind other structures are not illustrated.

The fixing device 100 includes a steering roller 101, a driving roller 102, a fixing pad 103, the endless belt 104, and a pressure roller 105. The steering roller 101, the driving roller 102, and the fixing pad 103 correspond to examples of belt support members of the present invention. The steering roller 101 also corresponds to an example of a control member of the present invention. The endless belt 104 corresponds to an example of the endless belt of the present invention. The pressure roller 105 corresponds to an example of the contact member of the present invention.

The endless belt 104 is stretched over the steering roller 101, the driving roller 102, and the fixing pad 103. The driving roller 102 is rotated by a motor (not illustrated). Thus, the endless belt 104 runs in a loop in an arrow D direction. When the endless belt 104 runs in a loop, the steering roller 101 is rotated by the endless belt 104, and the fixing pad 103 makes sliding contact with the inner surface of the endless belt 104. Furthermore, the steering roller 101, the driving roller 102, and the fixing pad 103 each accommodate a heater (not illustrated). The endless belt 104 is heated by these heaters while running in a loop.

The pressure roller 105 is urged against the fixing pad 103 with the endless belt 104 disposed therebetween, so the pressure roller 105 is in contact with the outer surface of the endless belt 104. The pressure roller 105 is rotated by the endless belt 104 running in a loop.

The fixing device 100 has a first guide 106 on the upstream side, in the sheet transporting direction (the arrow C direction, which is also indicated in FIG. 1), of a contact area where the endless belt 104 and the pressure roller 105 are in contact with each other. The first guide 106 guides the sheet P transported thereto to the contact area.

The sheet P with an unfixed toner image formed thereon is guided to the contact area by the first guide 106, is subjected to heating by the endless belt 104 and pressing by the pressure roller 105 while being transported through the contact area, and is further transported. As a result of the heating and pressing in the contact area, the unfixed toner image is fixed to the sheet P.

The fixing device 100 has a separation plate 107 and a second guide 108 on the downstream side of the contact area in the sheet transporting direction indicated by the arrow C. The separation plate 107 helps the sheet P discharged from the contact area after the fixing be separated from the endless belt 104 by its own stiffness and prevents the sheet P from being transported any further by the endless belt 104. The sheet P separated from the endless belt 104 after the fixing is guided to the output rollers 86 illustrated in FIG. 1 by the second guide 108.

In the fixing device 100, the steering roller 101, the driving roller 102, and the fixing pad 103, over which the endless belt 104 is stretched, are supported by support members described below.

The fixing device 100 includes a first support member 109 for supporting the steering roller 101, and a second support member 110 for supporting the driving roller 102 and the fixing pad 103. The first support member 109 and the second support member 110 together correspond to an example of support members of the present invention.

Figure 4:
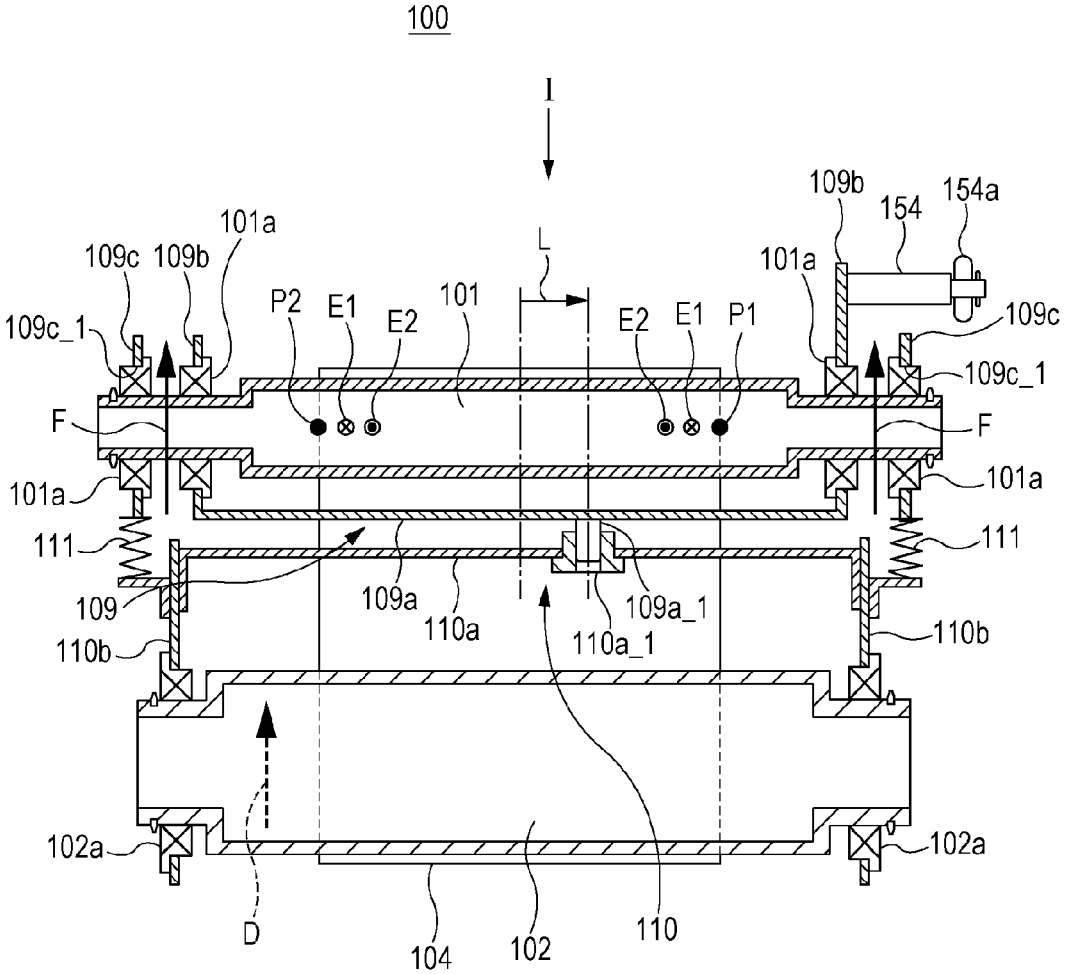
FIG. 4 is a schematic sectional view in the width direction of an endless belt, illustrating supporting structures in which rollers are supported by support members of the fixing device.

FIG. 4 is a schematic sectional view in the width direction of the endless belt, illustrating supporting structures in which the rollers are supported by support members of the fixing device.

The support structures for supporting the rollers will be described with reference to FIGS. 2, 3, and 4.

The steering roller 101 has two bearings 101*a* at each end.

The first support member 109 includes a flat-plate portion 109*a* disposed inside the endless belt 104, two inner walls 109*b* standing from the flat-plate portion 109*a*, and two outer walls 109*c* standing parallel to the inner walls 109*b*, on the outer side thereof.

As described above, the steering roller 101 has two bearings 101*a* at each end, and the inner bearings 101*a* are fixed to the inner walls 109*b*. Thus, the steering roller 101 is supported by the two inner walls 109*b* so as to be rotatable.

The outer walls 109*c* each have an elongated hole 109*c*_1 extending in an arrow E direction.

The outer bearings 101*a* are fitted to the elongated holes 109*c*_1 in the outer walls 109*c* so as to be freely movable in the arrow E direction. The outer walls 109*c* are urged in an arrow F direction by springs 111 fixed at one end to the outer walls 109*c* and at the other end to the second support member 110. Thus, the steering roller 101 is urged in the arrow F direction, applying tension to the endless belt 104 stretched around the steering roller 101.

The second support member 110 includes a flat-plate portion 110*a* arranged to face the flat-plate portion 109*a* of the first support member 109, and two side walls 110*b* securely sandwiching the flat-plate portion 110*a* therebetween.

The driving roller 102 has one bearing 102*a* at each end. The bearings 102*a* provided at the ends of the driving roller 102 are fixed to the side walls 110*b* of the second support member 110. Thus, the driving roller 102 is supported by the two side walls 110*b* so as to be rotatable. As has been described above, the driving roller 102 is rotated by the motor (not illustrated) in the arrow D direction, in which the endless belt 104 runs in a loop. Furthermore, the fixing pad 103 is disposed between the two side walls 110*b*, and the ends of the fixing pad 103 are fixed to the side walls 110*b*.

A pivot shaft 109*a*_1 is projecting from the flat-plate portion 109*a* of the first support member 109 toward the flat-plate portion 110*a* of the second support member 110.

The flat-plate portion 110*a* of the second support member 110 receives the pivot shaft 109*a*_1, so the flat-plate portion 110*a* of the second support member 110 has a bearing 110*a*_1 that supports the pivot shaft 109*a*_1 so as to be rotatable. Thus, the first support member 109, together with the steering roller 101 supported by the first support member 109, is supported by the second support member 110 so as to be rotatable about the pivot shaft 109*a*_1.

Furthermore, the fixing device 100 includes a steering mechanism 150 that causes an end of the steering roller 101 to pivot in the arrow E direction in FIG. 3. Because of this, the steering roller 101 pivots about the pivot shaft 109*a*_1, which serves as a pivot axis. The steering mechanism 150 corresponds to an example of a driving mechanism of the present invention.

The steering roller 101, the driving roller 102, the fixing pad 103, the endless belt 104, the first support member 109, the second support member 110, and the steering mechanism 150 of the fixing device 100 together correspond to an exemplary embodiment of the belt driving device of the present invention.

Figure 5:
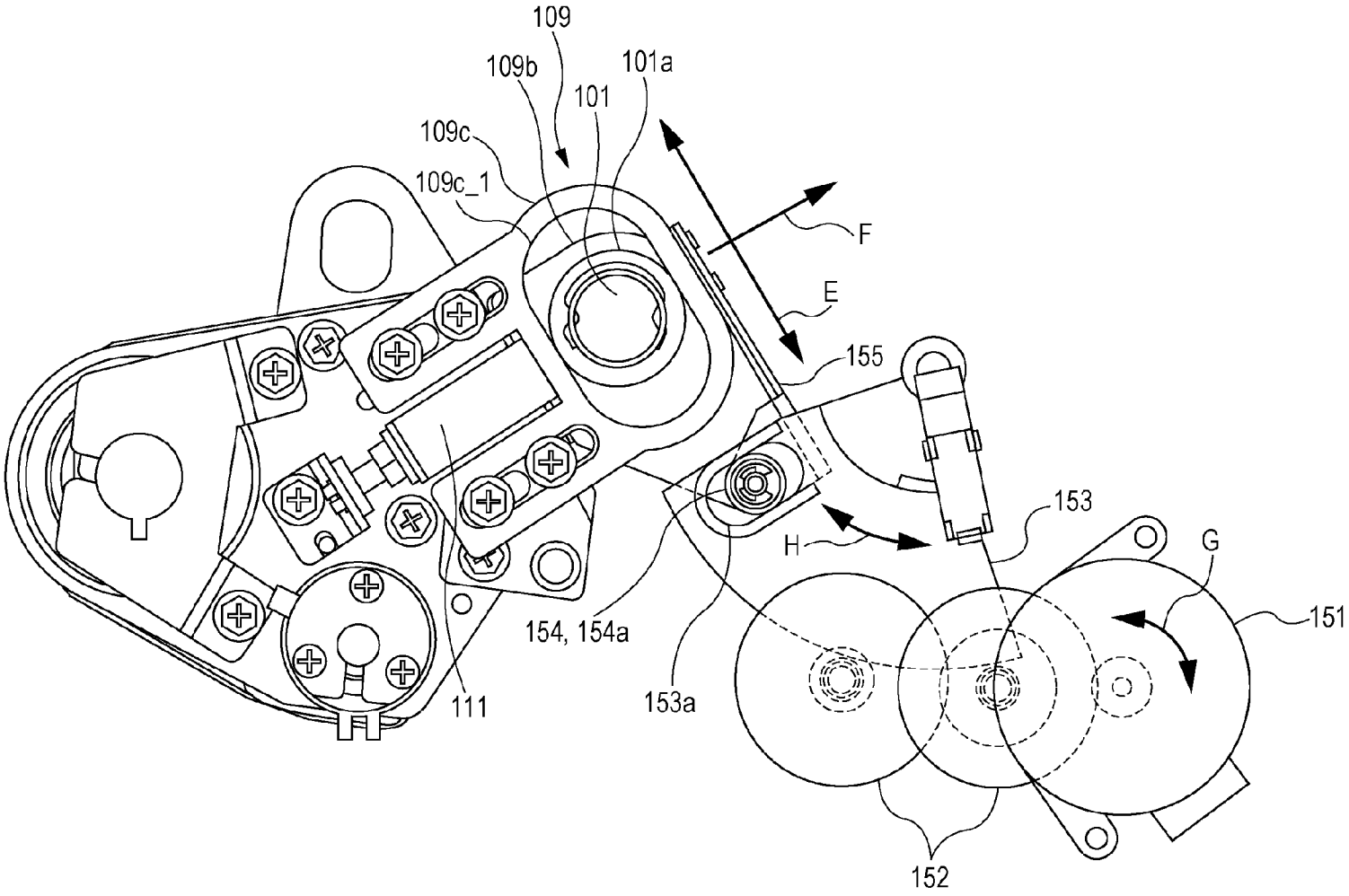
FIG. 5 schematically illustrates the internal structure of a steering mechanism.

FIG. 5 schematically illustrates the internal structure of the steering mechanism.

The steering mechanism 150 includes a motor 151, transmission gears 152, a pivot gear 153, a pulley joint 154, and an arm 155.

In this steering mechanism 150, the rotation shaft of the motor 151 meshes with the transmission gears 152, and the transmission gears 152 mesh with the pivot gear 153. The pivot gear 153 has an elongated hole 153*a*. The elongated hole 153*a* receives a pulley 154*a* provided at an end of the pulley joint 154, which is also illustrated in FIG. 4. The pulley joint 154 and the inner wall 109*b* of the first support member 109 are together fixed to the arm 155 projecting toward the steering mechanism 150.

In the steering mechanism 150, the rotational driving force exerted by the motor 151 in an arrow G direction is transmitted to the pivot gear 153 via the transmission gears 152. As a result, the pivoting of the pivot gear 153 in an arrow H direction is converted into straight reciprocation of the arm 155 in the arrow E direction by the pulley joint 154.

The steering roller 101, which, together with the outer walls 109*c*, is urged by the springs 111 in the arrow F direction pivots in the arrow E direction due to the straight reciprocation of the arm 155. At this time, the bearings 101*a* of the steering roller 101 move within the elongated holes 109*c*_1 provided in the outer walls 109*c*.

When one end of the steering roller 101 is pulled toward the motor 151 by the steering mechanism 150, the steering roller 101 is rotated about the pivot shaft 109*a*_1 illustrated in, for example, FIG. 4 and is inclined such that the one end on the motor 151 side is low and the other end is high, as viewed from the motor 151. In this state, the endless belt 104 wound around the steering roller 101 and running in a loop runs with a shift toward the steering mechanism 150 in the width direction.

When a sensor (not illustrated) detects that the endless belt 104 has shifted to a predetermined position toward the steering mechanism 150, the steering mechanism 150 pushes the one end of the steering roller 101 to the opposite side to the motor 151. As a result, the steering roller 101 is rotated about the pivot shaft 109*a*_1 illustrated in, for example, FIG. 4 and is inclined such that the one end on the motor 151 side is high and the other end is low, as viewed from the motor 151. In this state, the endless belt 104 runs with a shift toward the opposite side to the steering mechanism 150.

When the sensor (not illustrated) detects that the endless belt 104 has shifted to a predetermined position on the opposite side, the steering mechanism 150 pulls the one end of the steering roller 101 back toward the motor 151.

While the endless belt 104 is running in a loop, the one end of the steering roller 101 is caused to pivot by the steering mechanism 150, and the endless belt 104 runs while repeating the above-mentioned shift in the width direction. As a result, the endless belt 104 is heated by the steering roller 101, the driving roller 102, and the fixing pad 103 while moving in the width direction. Thus, the endless belt 104 is uniformly heated without temperature irregularity.

Furthermore, the steering mechanism 150 causes the steering roller 101 to pivot in a direction in which stretching of the endless belt 104 is prevented, more specifically, in a direction in which the endless belt 104 is twisted. Hence, in this fixing device 100, the endless belt 104 is a non-stretchable belt formed of polyimide or the like.

When the one end of the steering roller 101 moves as above, it is desirable that the moving distances of two points P1 and P2 (FIG. 4) on the steering roller 101 that are aligned with the edges of the endless belt 104 in the width direction be closer to each other.

That is, it is desirable that, when the first point P1 on the steering roller 101, which is aligned with the edge of the endless belt 104 on the steering mechanism 150 side, moves in a direction indicated by E1 in FIG. 4, the second point P2, which is aligned with the other edge, move by the same distance in a direction indicated by E2, which is opposite to E1.

Conversely, it is desirable that, when first point P1 moves in the direction indicated by E2 in FIG. 4, the second point P2, which is aligned with the other edge, move by the same distance in the direction indicated by E1.

If the difference between the moving distances of the two points P1 and P2 is large, the endless belt 104 may become slack at the side where the moving distance of the point is small.

To make the moving distances of the two points P1 and P2 equal, it is anticipated that the pivot shaft 109*a*_1, serving as the pivot axis of the steering roller 101, should be located at the midpoint of the endless belt 104 in the width direction. The midpoint of the endless belt 104 in the width direction herein refers to the average midpoint, in the width direction, of the endless belt 104, which moves in the width direction due to the rotation of the steering roller 101. Hereinbelow, the average midpoint in the width direction will be simply referred to as "midpoint in the width direction".

The moving distance of the first point P1 on the steering roller 101, which is aligned with the edge of the endless belt 104 on the steering mechanism 150 side is determined by the movement of the steering mechanism 150. On the other hand, the second point P2 on the steering roller 101, which is aligned with the other edge of the endless belt 104, does not move as much as the first point P1.

There is a small amount of gap between the pivot shaft 109*a*_1 and the bearing 110*a*_1 that is inevitably produced during the manufacturing process. Because of this gap, when the one end of the steering roller 101 is moved by the steering mechanism 150, a shift in position of the pivot shaft 109*a*_1 or a tilt of the first support member 1 supporting the steering roller occurs due to the tension of the endless belt 104.

Furthermore, when the one end of the steering roller 101 is moved by the steering mechanism 150, the steering roller 101 and the first support member 109 supporting the steering roller 101 are slightly bent due to the tension of the endless belt 104.

When the pivot shaft 109*a*_1 is located at the midpoint of the endless belt 104 in the width direction, because of these factors, against the above-described anticipation, the moving distance of the second point P2 on the other side is smaller than that of the first point P1 on the steering mechanism 150 side.

In contrast, as illustrated in FIG. 4, in the fixing device 100 according to this exemplary embodiment, the pivot shaft 109*a*_1, serving as the pivot axis of the steering roller 101, is disposed at a position shifted toward the steering mechanism 150 from the midpoint of the endless belt 104 in the width direction. With this amount of shift L, the moving distances of the first point P1 and second point P2 are closer to each other than those in the case where the pivot shaft 109*a*_1 is located at the midpoint of the endless belt 104 in the width direction. More specifically, the endless belt 104 having a width of 340 mm has an amount of shift of about 20 mm. In this manner, in the fixing device 100, the moving distances of the first point P1 and second point P2 are closer to each other than those in the case where the pivot shaft 109*a*_1 is located at the midpoint of the endless belt 104 in the width direction, and hence, the slack of the endless belt 104 is reduced.

Figure 6A:
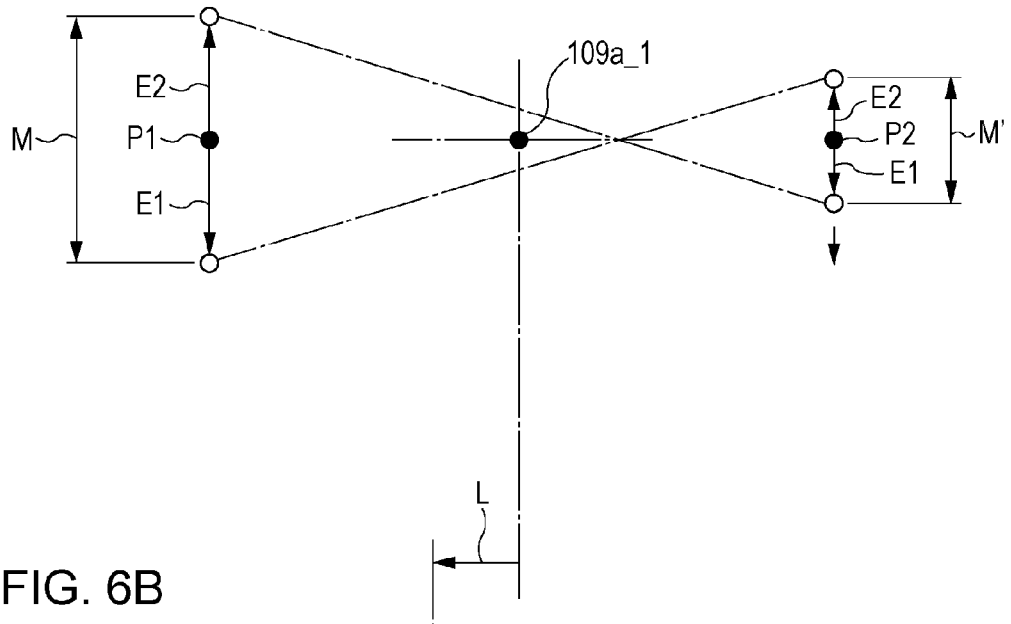
FIGS. 6A and 6B schematically illustrate that, with a configuration in which a rotation shaft is disposed at a position shifted toward the steering mechanism from the midpoint of the endless belt in the width direction, the moving distances of two points on a steering roller that are aligned with the edges of the endless belt in the width direction are closer to each other.
Figure 6B:
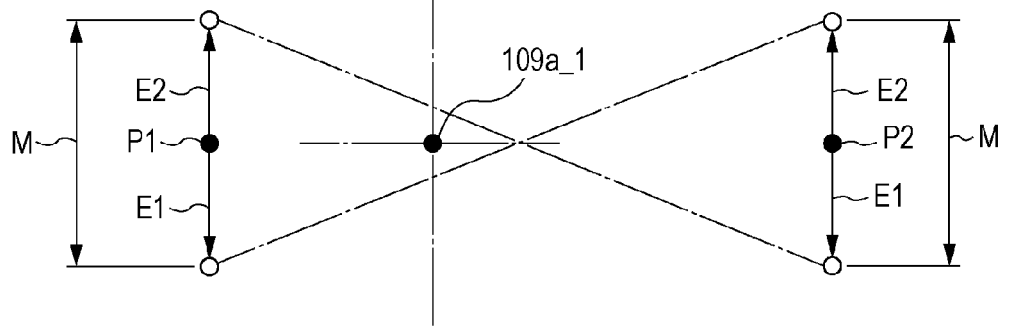

FIGS. 6A and 6B schematically illustrate that, with a configuration in which the rotation shaft is disposed at a position shifted toward the steering mechanism from the midpoint of the endless belt in the width direction, the moving distances of two points on the steering roller that are aligned with the edges of the endless belt in the width direction are closer to each other.

FIGS. 6A and 6B schematically illustrate the movement of the two points P1 and P2 on the steering roller 101 that are aligned with the edges of the endless belt 104 in the width direction, as viewed from an arrow I direction in FIG. 4.

FIG. 6A illustrates, for comparison, the movement of the two points P1 and P2 when the pivot shaft 109*a*_1 is located at the midpoint of the endless belt 104 in the width direction.

FIG. 6B illustrates the movement of the two points P1 and P2 in the fixing device 100 according to this exemplary embodiment.

In either cases in FIGS. 6A and 6B, the first point P1 on the steering mechanism 150 side moves toward the motor 151 (in an arrow E1 direction in FIG. 5) by a moving distance M, which is determined by the rotational speed of the motor 151 of the steering mechanism 150. The first point P1 also moves in an arrow E2 direction by the same moving distance, M.

When the first point P1 moves in the arrow E1 direction, the second point P2 on the other side moves in the arrow E2 direction opposite to the arrow E1 direction. When the first point P1 moves in the arrow E2 direction, the second point P2 moves in the arrow E1 direction.

When the pivot shaft 109*a*_1 is located at the midpoint of the endless belt 104 in the width direction, as illustrated in FIG. 6A, the second point P2 on the other side moves by a moving distance M', which is smaller than the moving distance M of the first point P1, due to the above-mentioned factors.

On the other hand, in the fixing device 100 according to this exemplary embodiment, in which the pivot shaft 109*a*_1 is disposed at a position shifted toward the steering mechanism 150 from the midpoint of the endless belt 104 in the width direction, as illustrated in FIG. 6B, the second point P2 on the other side moves by a distance substantially equal to the moving distance M of the first point P1.

Because the pivot shaft 109*a*_1 is shifted toward the steering mechanism 150 from the midpoint of the endless belt 104 in the width direction, the second point P2 located on the other side of the first point P1 tends to move by a larger distance than the moving distance M of the first point P1. The increased moving distance of the second point P2 is reduced by the above-mentioned factors. In this exemplary embodiment, the pivot shaft 109*a*_1 is shifted from the midpoint of the endless belt 104 in the width direction by such an amount that the reduced moving distance of the second point P2 is substantially equal to the moving distance M of the first point P1. More specifically, as described above, the endless belt 104 having a width of 340 mm has an amount of shift of about 20 mm.

In this exemplary embodiment, the endless belt 104 driven by the driving roller 102 supporting the endless belt 104 from the inside is illustrated as an example of the endless belt of the present invention. However, the endless belt of the present invention is not limited thereto. The belt driving device of the present invention may cause the belt to run in a loop by receiving a supply of the driving force from a component that is located outside the belt driving device and is in contact with the outer surface of the endless belt, such as the pressure roller 105 of the fixing device 100.

Furthermore, in this exemplary embodiment, a mechanism portion assembled in the fixing device 100 is illustrated as an exemplary embodiment of the belt driving device of the present invention. However, the belt driving device of the present invention is not limited thereto. The belt driving device of the present invention may be, for example, a belt transport device that transports a sheet on the belt or a belt cooling device that transports a sheet, having a toner image fixed thereto, on the belt while cooling.

Furthermore, in this exemplary embodiment, a tandem-type color printer is illustrated as an example of the image forming apparatus of the present invention. However, the image forming apparatus of the present invention may be a rotary color printer in which several developing units are arranged around a rotation shaft, or a monochrome printer. The image forming apparatus of the present invention is not limited to a printer, but may be a copier or a facsimile.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt driving device comprising:

an endless belt that is run in a loop by receiving a supply of driving force;

support members that extend in a width direction of the endless belt and support the endless belt, the support members including a control member that controls the widthwise position of the endless belt;

a support body that supports the support members; and a driving mechanism that drives one end of the control member to cause the control member to pivot about a pivot axis, which is located at a position overlapping the endless belt, in a direction in which stretching of the endless belt is prevented, wherein a portion of the control member shifted from the midpoint toward an edge of the endless belt in the width direction is supported in a pivotable manner by the support member to serve as the pivot axis, so that the moving distances of two points on the control member that are aligned with the edges of the endless belt in the width direction when the control member is driven by the driving mechanism are closer to each other than those in the case where the pivot axis is located at the midpoint of the endless belt in the width direction.

2. A fixing device comprising:

an endless belt that is run in a loop by receiving a supply of driving force;

support members that extend in a width direction of the endless belt and support the endless belt, the support members including a control member that controls the widthwise position of the endless belt;

a support body that supports the support members;

a driving mechanism that drives one end of the control member to cause the control member to pivot about a pivot axis, which is located at a position overlapping the endless belt, in a direction in which stretching of the endless belt is prevented; and a contact member that is in contact with the outer surface of the endless belt with a medium having an unfixed toner image therebetween, the contact member and the endless belt together fixing the toner image onto the medium, wherein a portion of the control member shifted from the midpoint toward an edge of the endless belt in the width direction is supported in a pivotable manner by the support member to serve as the pivot axis, so that the moving distances of two points on the control member that are aligned with the edges of the endless belt in the width direction when the control member is driven by the driving mechanism are closer to each other than those in the case where the pivot axis is located at the midpoint of the endless belt in the width direction.

3. An image forming apparatus comprising:

an image forming section in which an electrostatic latent image is formed, the electrostatic latent image is developed with toner to form a toner image, and the toner image is transferred to a medium; and a fixing section that fixes the unfixed toner image transferred to the medium onto the medium, the fixing section including an endless belt that is run in a loop by receiving a supply of driving force; support members that extend in a width direction of the endless belt and support the endless belt, the support members including a control member that controls the widthwise position of the endless belt; a support body that supports the support members; a driving mechanism that drives one end of the control member to cause the control member to pivot about a pivot axis, which is located at a position overlapping the endless belt, in a direction in which stretching of the endless belt is prevented; and a contact member that is in contact with the outer surface of the endless belt with the medium having the unfixed toner image therebetween, the contact member and the endless belt together fixing the toner image onto the medium, wherein a portion of the control member shifted from the midpoint toward an edge of the endless belt in the width direction is supported in a pivotable manner by the support member to serve as the pivot axis, so that the moving distances of two points on the control member that are aligned with the edges of the endless belt in the width direction when the control member is driven by the driving mechanism are closer to each other than those in the case where the pivot axis is located at the midpoint of the endless belt in the width direction.

* * * * *